United States Patent [19]

DeMoore

[11] Patent Number: 5,046,421

[45] Date of Patent: Sep. 10, 1991

[54] NET CARTRIDGE ASSEMBLY FOR USE WITH TRANSFER AND DELIVERY CYLINDERS IN ROTARY PRINTING PRESSES

[76] Inventor: Howard W. DeMoore, 2552 Royal La., Dallas, Tex. 75299

[21] Appl. No.: 452,839

[22] Filed: Dec. 19, 1989

[51] Int. Cl.[5] ..... B41F 21/00

[52] U.S. Cl. ..... 101/420; 242/55.2; 242/68.4

[58] Field of Search ..... 101/418, 417, 419, 420, 101/483; 242/55.2, 68.4

[56] References Cited

U.S. PATENT DOCUMENTS

| | | | |
|---|---|---|---|
| 2,889,122 | 6/1959 | McConnell | 242/55.2 |
| 3,126,826 | 3/1964 | Fischer | 101/420 |
| 3,362,653 | 1/1968 | Carlisle | 242/55.2 |
| 3,823,889 | 7/1974 | Johnson et al. | 242/55.2 |
| 4,572,692 | 2/1986 | Sauber | 242/68.4 X |
| 4,691,632 | 9/1987 | DeMoore | 101/419 X |

*Primary Examiner*—Clifford D. Crowder

*Attorney, Agent, or Firm*—Kelly, Bauersfeld & Lowry

[57] ABSTRACT

A cartridge assembly for providing a source of anti-smear fabric net material to be used to cover the support surface of a transfer or delivery cylinder in a printing press, the assembly comprising an axle assembly mounted to brackets attached to the cylinder and having a replaceable cartridge roll wound with a continuous supply of fabric net material supported thereon. Structure is provided for releasably locking the axle assembly against removal from the brackets, and for releasably locking the axle assembly against rotation relative to the brackets.

19 Claims, 3 Drawing Sheets

FIG. 1
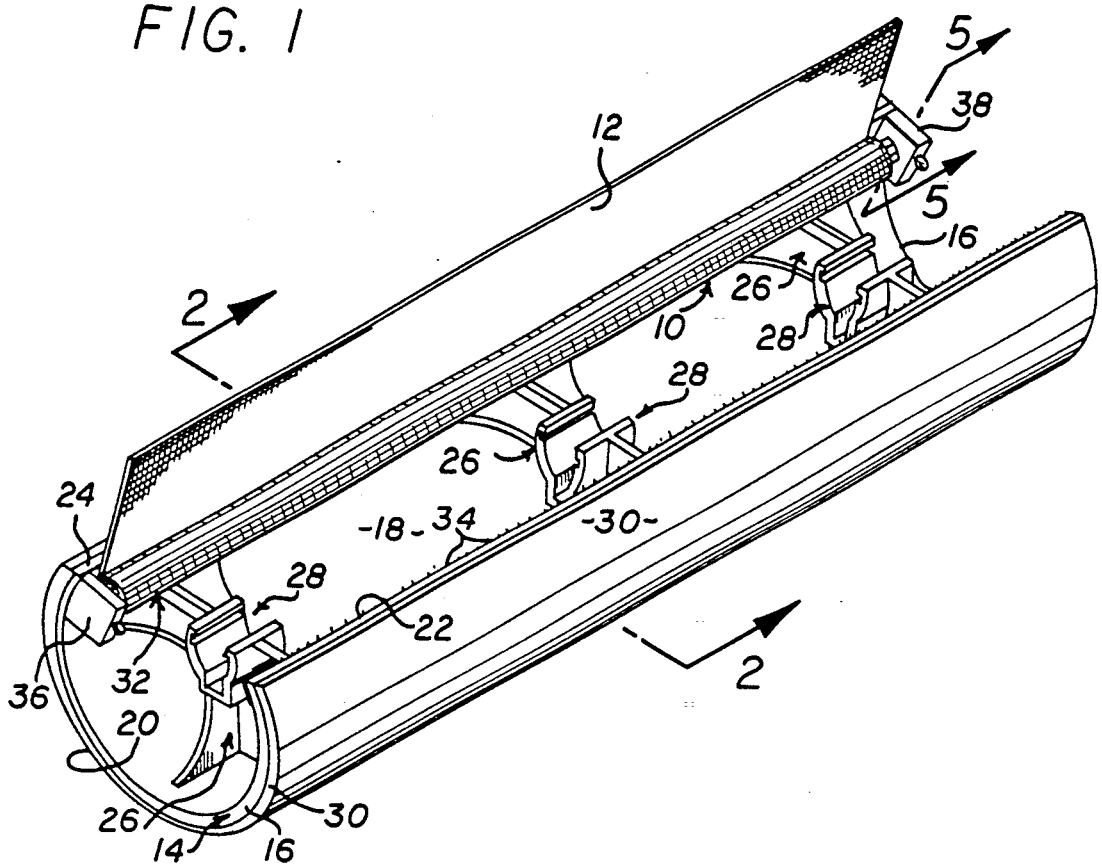
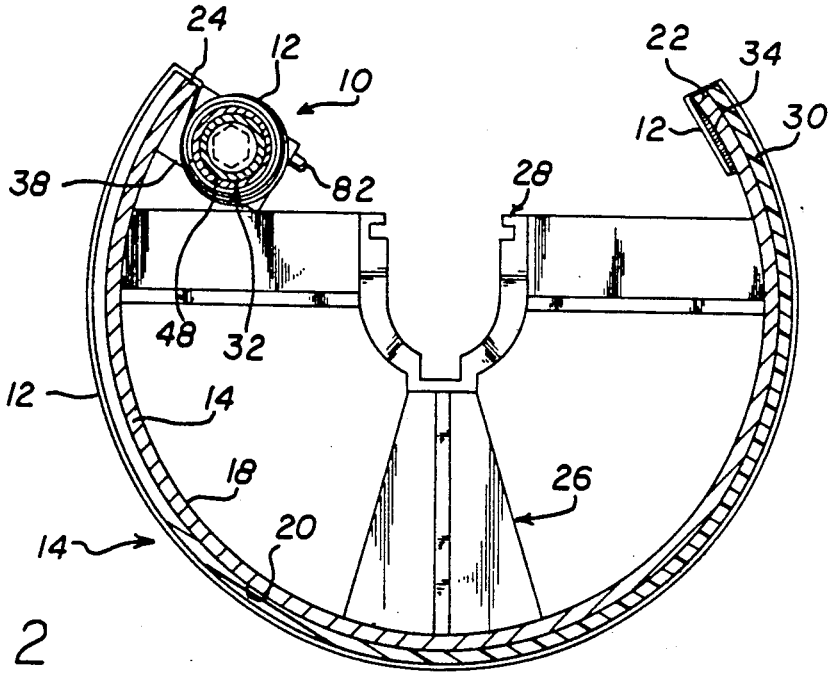
FIG. 2

FIG. 3
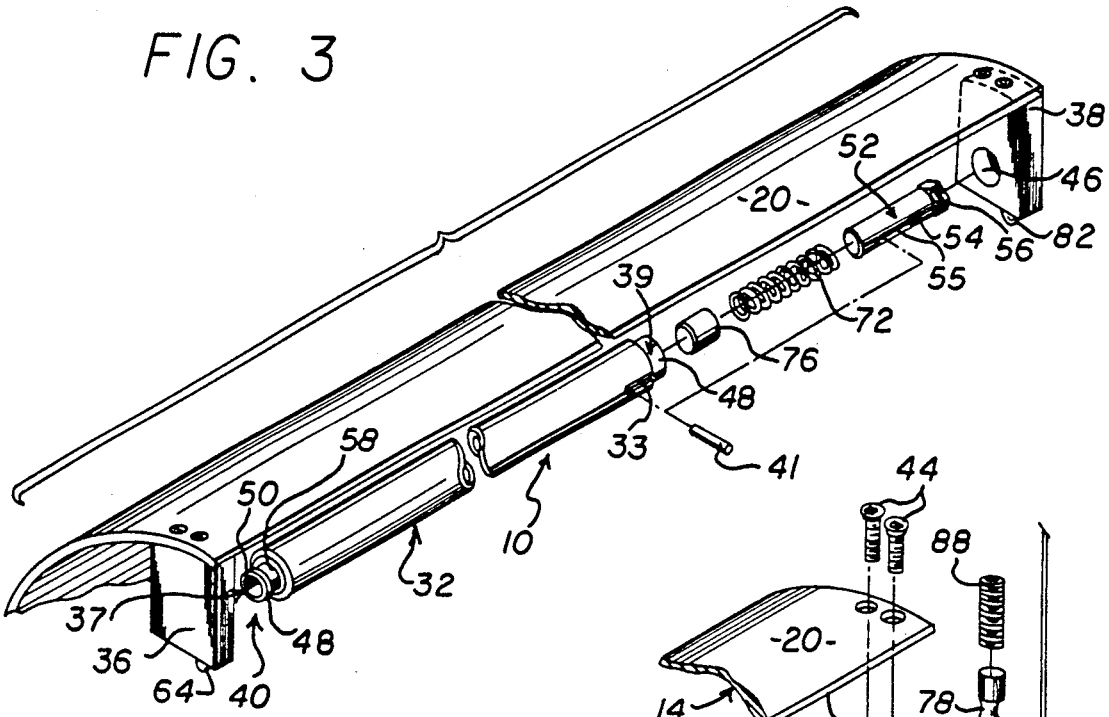
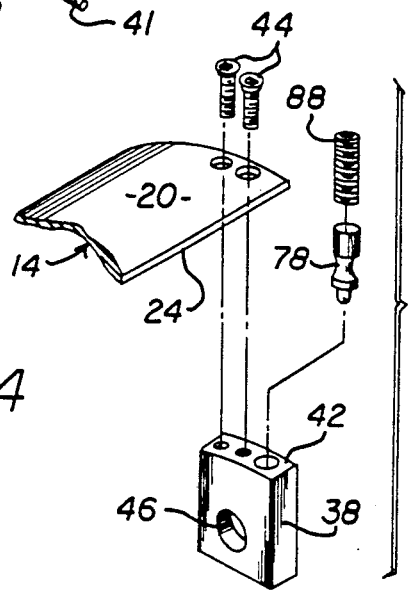
FIG. 4
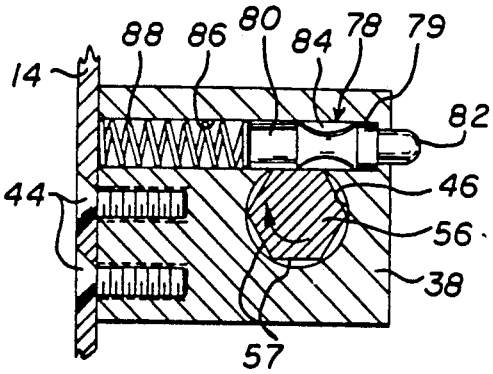
FIG. 5
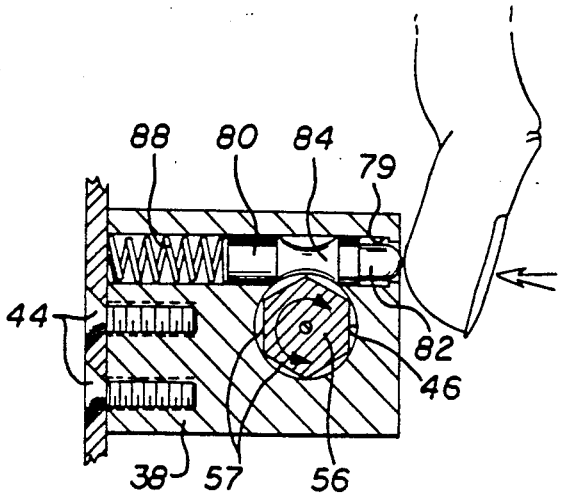
FIG. 6

FIG. 7
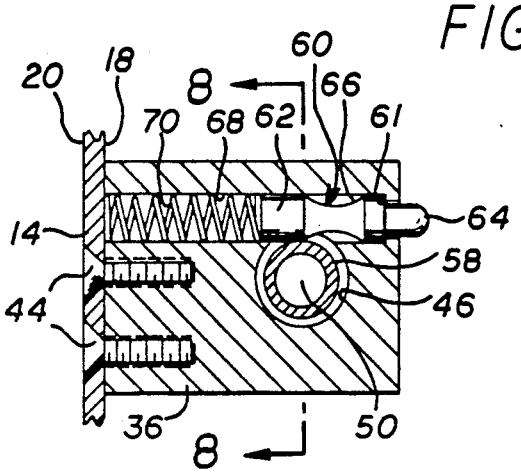
FIG. 8
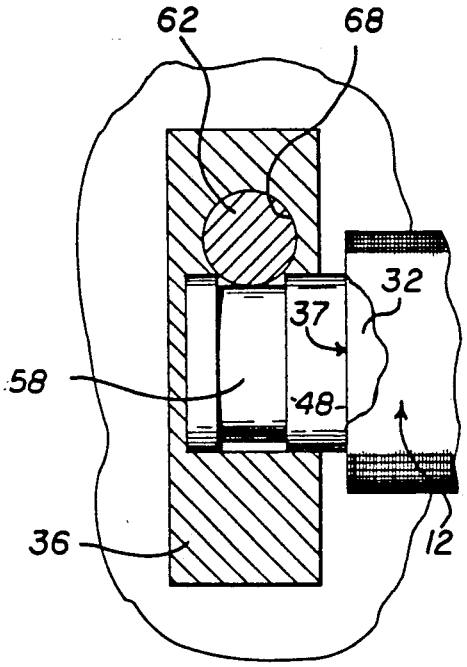
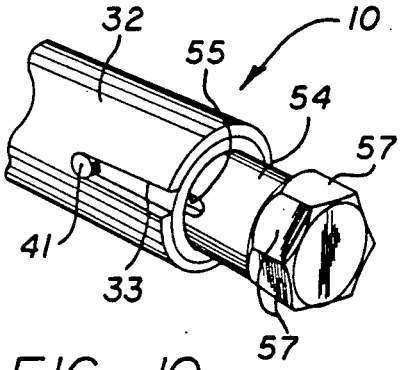
FIG. 10
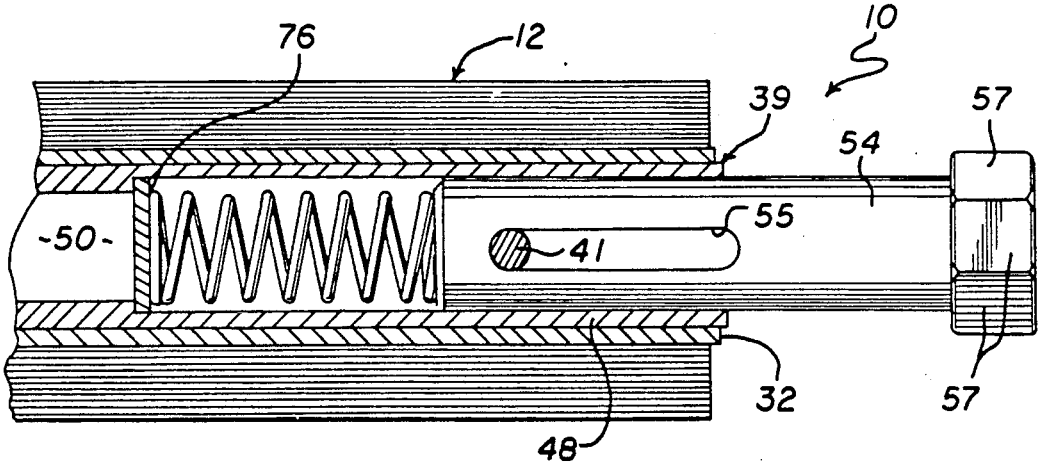
FIG. 9

NET CARTRIDGE ASSEMBLY FOR USE WITH TRANSFER AND DELIVERY CYLINDERS IN ROTARY PRINTING PRESSES

BACKGROUND OF THE INVENTION

This invention relates to printing presses, and more particularly to a new and improved cartridge assembly for providing a source of fabric net material to be used to cover the support surface of a transfer or delivery cylinder in a high speed, sheet fed off-set rotary printing press.

Disclosed in my U.S. Pat. No. 4,402,267 issued Sept. 6, 1983 and entitled "Method And Apparatus For Handling Printed Sheet Material", is a system for preventing the marking and marring of freshly printed sheets in a high speed, sheet fed off-set rotary printing press as the wet inked side of those sheets are supported by a transfer or delivery wheel or cylinder during transfer between processing stations within the press. That system, which has met with very substantial commercial success and worldwide acceptance in the printing industry, employs an ink repellent fabric material, referred to in the trade as a "net", loosely disposed over the support surface of the transfer or delivery cylinder, and which engages and clings to the wet ink side of the sheet as the sheet it being transferred over the cylinder.

As described in my aforementioned U.S Pat. No. 4,402,267, it is important that the net be properly tensioned over the cylinder so that the net remains relatively loose during operation. In my later U.S. Pat. No. 4,691,632 issued Sept. 8, 1987, there is disclosed a method and apparatus for attaching the anti-smear net to the cylinder so that the net may be readily and easily removed, installed and adjusted for proper tension. That later patent employs a pair of identical reel assemblies, one disposed adjacent the leading or gripper edge of the cylinder, and the other disposed adjacent the trailing or tail edge of the cylinder, and to which each end of the net is attached. By winding the net onto the reels, the proper tension of the net over the support surface of the cylinder can be maintained.

While the reel assemblies disclosed in my U.S. Pat. No. 4,691,632 have simplified the mounting of nets to the cylinder and the maintenance of proper net tension during the useful life of the net, the net must still periodically be replaced when it becomes soiled and/or worn out after prolonged use and begins to mark the sheets, or if the net is in some way damaged or torn during operation. It has been found that frequently the net will become soiled in only a small area, typically adjacent the leading or gripper edge, and that when this occurs, the entire net will have to be removed from the press and replaced with an entirely new net. This requires that the press be stopped and the old net removed from the cylinder. Thereafter, the entire new net must be reinstalled over the cylinder by attaching the ends to the gripper and tail edges of the cylinder, a process which can result in significant loss of press production time while the net is removed and a new net reinstalled.

Additionally, during operation of the press, the net material may be required to be adjusted to insure that the proper net tension over the cylinder is achieved for the particular printing job being run. This frequently requires that the press be stopped and the net tension adjusted by tightening the net slightly over the cylinder surface, since the net material may become stretched after prolonged use.

Thus, there exists a need for a new and improved method and apparatus for permitting only the soiled or damaged portion of the net to be quickly and easily replaced and/or the net tension adjusted with a minimum of lost press production time, yet which is simple, relatively inexpensive and highly reliable. As will become more apparent from the following detailed description, the present invention solves this need in a unique and unobvious way.

SUMMARY OF THE INVENTION

The present invention provides a new and improved method and apparatus for permitting any amount of fabric net material to be replaced over the support surface of a transfer or delivery cylinder, and which is relatively simple in design, inexpensive to manufacture, yet is highly reliable in use and permits rapid net replacement and tension adjustment to minimize lost press production time. The present invention provides a cartridge assembly preferably mounted to the tail edge of a transfer or delivery cylinder and which supports a replaceable cartridge roll having a continuous supply of fabric net material wound thereon. The cartridge assembly and replaceable roll provide a source of supply of net material which can be quickly and easily advanced from the roll to replace any amount of old net material on the cylinder, from an amount sufficient to cover the entire support surface of the cylinder, to an amount sufficient to replace only a very small soiled or damaged portion of the net. With the cartridge assembly of the present invention, replacement of soiled or damaged net material and uniform adjustments in the net tension can be done very quickly, thereby minimizing the amount of lost press production time necessary to effect net replacement and adjustment. Moreover, with the replaceable cartridge of the present invention, a new supply of net material can be quickly and easily installed in the press by installing a new cartridge roll on the axle assembly whenever the old cartridge has become spent.

In accordance with the invention, the cartridge assembly includes a pair of mounting brackets attached to the inner surface of the cylinder adjacent each end, and which support an axle assembly on which the replaceable cartridge roll is mounted. The cartridge assembly preferably extends along the tail edge of the cylinder, and includes means for releasably mounting and locking the axle assembly to the brackets. Means are also provided to releasably lock the cartridge assembly against rotation in one direction relative to the brackets to prevent the net material from unwinding from the cartridge roll during press operation, yet which can be simply and quickly released to permit fabric net material to be unwound from the cartridge roll when ever desired. Moreover, the releasable lock means includes a ratchet mechanism which permits the cartridge roll to be rotated in a direction to wind the fabric net material onto the roll without having to unlock the cartridge assembly, thereby to permit tightening adjustment of the net tension over the cylinder whenever net tensioning becomes necessary.

The many features and advantages of the present invention will become more apparent from the following detailed description, taken in conjunction with the accompanying drawings which illustrate, by way of example, the principles of the invention.

BRIEF DESCRIPTION OF THE DRAWINGS

FIG. 1 is a perspective view of a transfer or delivery cylinder to which is mounted a cartridge assembly embodying the present invention, and illustrating the removal of fabric net material from the cartridge roll;

FIG. 2 is an enlarged cross-sectional view of the cylinder of FIG. 1 taken substantially along line 2—2 thereof, and illustrating the net as attached over the cylinder and ready for use;

FIG. 3 is a fragmentary exploded perspective view, partially in cross-section, illustrating the component parts of the cartridge assembly of the present invention;

FIG. 4 is an enlarged fragmentary exploded perspective view, partially in cross-section, of the component parts of the mounting bracket for supporting the right side end of the cartridge assembly as seen in FIG. 3;

FIG. 5 is a further enlarged fragmentary cross-sectional view of the mounting bracket of FIG. 4 showing the cartridge assembly locked against rotation in one direction to prevent unwinding of the net material;

FIG. 6 is a cross-sectional view similar to FIG. 5 showing the release of the cartridge assembly for free rotation relative to the mounting brackets;

FIG. 7 is an enlarged fragmentary cross-sectional view of the mounting bracket for the left side of the cartridge assembly as shown in FIG. 3 and illustrating the cartridge assembly locked to the bracket against removal;

FIG. 8 is an enlarged cross-sectional view taken substantially along line 8—8 of FIG. 7;

FIG. 9 is a fragmentary cross-sectional view of the right side of the cartridge assembly as shown in FIG. 3 and showing the cartridge assembly in assembled form; and FIG. 10 is a fragmentary perspective view of the right end of the cartridge assembly as shown in FIG. 9 but without the fabric net material wound thereon.

DETAILED DESCRIPTION OF PREFERRED EMBODIMENT

As shown in the exemplary drawings, the present invention is embodied in a cartridge assembly, generally designated by the reference numeral 10, intended to be used to provide a source of supply of ink repellant fabric material 12, referred to in the trade as a "net", for covering the outer support surface of a transfer or delivery wheel or cylinder 14 in a high speed, sheet fed off-set rotary printing press (not shown). In this instance, the transfer or delivery cylinder 14 is of the general type illustrated and described in my aforementioned U.S. Pat. No. 4,402,267, and is intended to be mounted in a printing press to support the wet ink side of a printed sheet as the sheet is transferred from one processing station within the press to another or to the delivery end of the press, as is well understood by those skilled in the printing press art.

Herein, the cylinder 14 is formed as a cylindrical shell having axially spaced ends 16 and an inner surface 18 and an outer support surface 20 which are discontinuous so as to form an axially extending opening defining a cylinder leading or gripper edge 22 and a cylinder trailing or tail edge 24, the opening being provided for cooperating with a gripper bar assembly (not shown) within the press which functions to withdraw and carry the printed sheet as it moves around the cylinder. Projecting radially inwardly from the inner surface 18 of the cylinder 14 are axially spaced mounting webs 26 terminating in U-shaped shaft brackets 28 for attaching the cylinder to a drive shaft (also not shown) within the press, the specific mounting and operation to the cylinder within the press being well known and understood by those skilled in the printing press art.

As described in my aforementioned U.S. Pat. No. 4,402,267, the outer support surface 20 of the cylinder 14 is provided with a coating or covering of low friction material 30 over which the fabric net 12 is loosely disposed, the low friction coating permitting the net to cling to the printed sheet yet allowing the net to move relative to the support surface 20 of the cylinder 14 during transfer of a printed sheet, thereby to eliminate marking and marring of the wet ink surface. The net 12, which may be of the type manufactured and sold by Printing Research, Inc., of Dallas, Texas, under its registered trademark "SUPER BLUE", preferably is formed from loosely woven cotton cloth treated with an ink repellant substance such as that manufactured by the 3M Manufacturing Company, Minneapolis, Minn. under its Part No. FC4101-C-12, and is formed to have an unstretched width substantially equal to the axial length of the cylinder 14 so as to extend completely across the support surface 20 between the axial ends 16 of the cylinder.

In accordance with a primary aspect of the present invention, the cartridge assembly 10 is mounted to the inner surface 20 of the cylinder 14 herein adjacent the tail edge 24, and supports a replaceable cartridge roll, herein generally designated by the reference numeral 32, about which is wound a continuous supply of fabric net material 12. The cartridge assembly 10 and replaceable cartridge roll 32 provide a source of supply of net material 12 which can be quickly and easily pulled from the roll over the support surface 20 of the cylinder 14 and attached to the gripper edge 22, herein by securing the end of the net to an attaching strip 34, preferably a strip of the type made under the trademark VELCRO, disposed along the inner surface 20 of the cylinder adjacent the gripper edge. Moreover, the cartridge assembly 10 and removable cartridge roll 32 are constructed to operate in a highly reliable and effective manner to permit any amount of net material to be withdrawn from the roll, from an amount sufficient to provide a totally new net over the cylinder, to a very small amount sufficient to only replace a small portion of the net covering the cylinder, and when the supply of net material 12 has been exhausted from the roll, a new supply of net material can be quickly and easily replaced in the cartridge assembly.

Toward the foregoing ends, as best can be seen in FIG. 3, which illustrates, in exploded perspective, the cartridge assembly 10 and cartridge roll 32 without the supply of fabric net material wound therearound, the cartridge assembly 10 includes a pair of mounting brackets 36 and 38, one disposed adjacent each axial end 16 of the cylinder 14, and which function to support an axle assembly 40 extending axially along the tail edge 24 of the cylinder between the brackets, and about which the cartridge roll 32 is disposed. Herein, each bracket 36 and 38 is formed as a generally rectangular block, preferably of metal, having a radially outer peripheral surface 42 formed with a curve corresponding to the curvature of the inner surface 18 of the cylinder 14, and is secured to the cylinder by counter-sunk screws 44 to project radially inwardly from the inner surface of the cylinder. Each bracket 36 and 38 is also provided with a blind cylindrical socket 46 dimensioned to receive one end of the axle assembly 40 for rotation therein, the sockets being formed to open toward each other along an axis parallel with the tail edge 24 of the cylinder 14 so that when the axle assembly 40 is mounted to the brackets, the center line of the axle assembly will be parallel with the tail edge and spaced radially inwardly from the inner surface 18 of the cylinder 14.

The axle assembly 40 is formed to be removably mounted to the brackets 36 and 38 of the cylinder 14, and when the press is in use, will normally be locked against rotation in the clockwise direction as viewed from the left end in FIG. 1 relative to the brackets, to prevent the fabric net material 12 from unwinding from the cartridge roll 32 when the press is in use. As shown herein, the axle assembly 40 includes an elongated tubular axle 48 of circular cross-section having a length that is equal to or slightly less than the distance between the facing sides of the brackets 36 and 38, and has a cylindrical passageway 50 extending longitudinally therethrough. Projecting outwardly from one end of the passageway 50 of the axle 48, herein the right end 39 as viewed in FIG. 3, is a plunger 52, preferably formed of metal, and having a cylindrical stem portion 54 dimensioned to slideably fit within the passageway 50 and an enlarged hexagonal shaped head portion 56 having flat faced sides 57, and is adapted and dimensioned to be rotatively received in the socket 46 of the adjacent bracket 38. The opposite end of the axle 48, that is, the left end 37 as viewed in FIG. 3, is dimensioned to be rotatively received in the socket 46 of its adjacent bracket 36, and is adpated to be releasably locked within the socket of the bracket. Importantly, the socket 46 of the left side bracket 36 as viewed in FIG. 3 is formed to have a smaller diameter than that of the socket in the right side bracket 38 so that the axle assembly 40 can only be installed in the brackets in the manner shown in FIG. 3.

In this instance, as best seen in FIGS. 3, 7 and 8, the axle 48 is provided with an annular recess 58 formed adjacent the left end 37 to lie inside the socket 46 of the bracket 36, and which cooperates with a spring biased lock pin 60 mounted to the bracket to lock the axle assembly 40 in position. The lock pin 60 herein comprises a plunger, preferably of metal, having a cylindrical shank portion 62 terminating in a relatively small diameter nipple portion 64, and is provided with an annular groove 66 formed in the shank adjacent the junction with the nipple portion. The lock pin 60 is received for sliding movement between extended and retracted positions in a bore 68 formed in the bracket 36 and which is located to intercept the socket 46 such that when the lock pin is installed within the bore, the cylindrical shank portion 62 will be aligned with and lie in the annular recess 58 of the axle 48.

A spring 70 is positioned in the bore 68 to bias the lock pin 60 toward the extended position with the shank portion 62 in the recess 58 and the nipple portion 64 projecting outwardly from the radially inner face of the bracket 36, a stop shoulder 61 being formed by a reduced diameter section of the bore to prevent the pin from being withdrawn from the bracket. With the lock pin 60 in the extended position as shown in FIG. 7, the shank portion 62 will lie in the recess 58 to prevent the left end 37 of the axle 48 from being withdrawn from the socket 46, and the axle can be released from the socket only by depressing the nipple 64 to retract the lock pin against the bias of the spring 70 and bring the groove 66 in the shank into alignment with the recess 58 in the axle, the depth of the groove being formed to permit the left end of the axle to be withdrawn past the locking pin when aligned therewith.

At the right end 39 of the axle assembly 40, as best can be seen in FIGS. 5, 6 and 9, the plunger 52 is mounted with the stem portion 54 disposed in the passageway 50 and biased outwardly therefrom by a spring 72 which is compressed between the end of the stem opposite the head 56 and a cylindrical plug 76 seated against an internal shoulder 74 formed by a reduced diameter portion of the passageway inwardly of the end of the axle 48. The plug 76 functions to prevent the inner end of the spring 72 from distorting and moving further into the passageway 50. With this arrangement, the plunger 52 is normally biased by the spring 72 toward an extended position so that the axle assembly 40 can be installed in and removed from the brackets 36 and 38 simply and quickly by compressing the plunger into the passageway 50 against the bias of the spring 7 to free the right end 39 of the axle from engagement with its socket 38, and then depressing the nipple 64 of the lock pin 60 to release the left end 37 for withdrawal of the axle from the bracket 36. Preferably, the head 56 of the plunger 52 is larger than the left end 37 of the axle 48 and the socket 46 for receiving the head of the plunger will have a larger diameter than that of the socket within which the left end is mounted so that the axle assembly 40 can only be installed with the plunger in the proper bracket and cannot be accidently reversed.

The replaceable cartridge roll 32, which preferably is formed from a relatively inexpensive material such as PVC plastic, is tubular in shape and is mounted to the axle 48 by sliding the roll over one of the ends, herein the left end 37, the length of the roll being slightly less than the length of the space between the inside faces of the mounting blocks 36 and 38 to permit the axle assembly 40 to be removed from the brackets. Prior to assembly onto the axle 48, the roll 32 is wound with an amount of fabric net material 12 sufficient to permit recovering of the support surface 20 of the cylinder 14 numerous times, the only restriction on the amount of material used being space limitations dictated by the particular type of press and the radial space available inside the cylinder shell. Typically, sufficient net material 12 can be provided to approximately equal six times the surface area of the support surface 20 of a cylinder 14.

As best seen in FIGS. 3, 9 and 10, to couple the cartridge roll 32 to the axle 48, herein a coupling pin 41 is secured transversely through the axle and extending into diametrically opposed, axially directed blind slots 33 formed in the end of the roll, the pin having a length equal to the diameter of the outer surface of the roll such that with the roll installed on the axle, the end portions of the pin will be received in the slots and couple the axle to the roll. The pin 41 projects through an elongated slot 55 formed diametrically through the stem portion 54 of the plunger 52, the slot having an axial length sufficient to permit the plunger to be moved between the extended and retracted positions for removal and reassembly of the axle assembly 40 in the brackets 36 and 38. With this arrangement, once the supply of net material 12 has been exhausted from the roll 32, a new cartridge roll with fabric net material wound thereon can be quickly and easily replaced on the axle assembly, thereby minimizing the lost press production time required for net changes. That is, all that need be done to replace the cartridge roll 32 is to remove the axle assembly 40 from the brackets 36 and 38 and slide the spent cartridge roll off the axle 48, and then slide a new cartridge roll with a new supply of net material 12 wound therearound onto the axle and replace the axle assembly into the brackets. Of course, should it be desirable to rewind new net material 12 onto the old roll 32, this can also be done by attaching the free end of a continuous supply of net material to the surface of the spent roll, typically by using an adhesive strip or other fastening means such as a VELCRO strip, and then winding the desired amount of fabric onto the roll.

When in use, the axle assembly 40 and the cartridge roll 32 are locked in position and can not be rotated relative to the brackets 36 and 38 in a direction to unwind the fabric net material 12. When it is desired to withdraw fabric net material 12 from the roll 32 for replacing soiled or damaged net material over the support surface 20 of the cylinder 14, the axle assembly 40 can be quickly and easily released from its locked condition to permit unrestricted and free rotation of the axle 48 relative to the brackets 36 and 38. Toward this end, the hexagonal head 56 of the plunger 52 is dimensioned to be rotatively received in the socket 4 of the adjacent bracket 38, and a spring biased lock pin 78, which is generally similar in construction to that of the lock pin 60 for locking the left end 37 of the axle 48 to the bracket 36, is provided for releasably locking the axle against rotation in one direction with respect to the bracket.

As best can be seen in FIGS. 5 and 6, the lock pin 78 comprises a plunger formed by a cylindrical shank portion 80 terminating in a nipple portion 82 of reduced diameter, and having an annular groove 84 disposed about the shank adjacent the nipple. The lock pin 78 is disposed for movement between extended and retracted positions in a bore 86 formed in the bracket 38 to intercept the socket 46 such that when the pin is in the extended position, the cylindrical shank portion 80 will abut one of the flat faces 57 of the hexagonal head 56 of the plunger 52. A spring 88 is compressed within the bore 86 against the end of the shank 80 and biases the lock pin 78 toward the extended position with the nipple 8 projecting outwardly from the inner face of the bracket 38, a stop shoulder 79 being formed by a reduced diameter portion of the bore to prevent the pin from being withdrawn from the bracket. With the lock pin 78 in the extended position shown in FIG. 5, the head portion 56 of the plunger 52 is prevented from rotating in the clockwise direction within the socket 46 which, of course, also will prevent the plunger 52, axle 48, and cartridge roll 32 from being rotated in that direction. By locking the axle assembly 40 and cartridge roll from rotating in the clockwise direction relative to the brackets 36 and 38 as viewed in FIG. 5, the axle assembly 40 is prevented from turning in a direction to permit unwinding of the net material 12, thereby maintaining net tension over the support surface 20 of the cylinder 14 during press operation.

To permit the axle assembly 40 and cartridge roll 32 to rotate for removal of net material 12, all that need be done is to depress the nipple 82 as shown in FIG. 6 to move the lock pin 78 inwardly against the bias of the spring 88 and bring the groove 84 into alignment with the head 56 so that the head will be free to rotate within the socket 46, the groove being herein formed as a radiused curve having a diameter substantially equal to the maximum effective diameter of the hexagonal head 56 so that the groove has a depth sufficient to permit the hexagonal head to rotate freely when alined therewith. Once the lock pin 78 has been depressed to permit the cartridge roll 32 to be rotated, any amount of fabric net material 12 can be removed quickly and easily from the roll. After the net material 12 has been withdrawn from the cartridge roll 32, by releasing the lock pin 78, the axle assembly 40 and cartridge roll will again be locked against rotation in the clockwise direction since the spring 88 will return the shank 80 to the extended position abutting the head 56.

In accordance with another important aspect of the present invention, the hexagonal head 56 of the plunger 52 cooperates with the lock pin 78 to form a ratchet mechanism which permits the axle assembly 40 to be rotated in the counter clockwise direction as seen in FIG. 5 without having to depress the lock pin, thereby to permit the tension of the net material 12 over the support surface 20 of the cylinder 14 to be tightened quickly and easily with a minimum of lost press production time. As can best be seen in FIG. 5, with the lock pin 78 in the extended position, the shank portion 80 is engaged with a portion of one of the flat faces 57 of the head 56. Should, however, a torque in the counter clockwise direction be applied to the axle assembly 40, the hexagonal head will rotate into the groove 84 and abut against the increasing radius portion of the groove to cause the lock pin to retract slightly against the bias of the spring 88. This retraction of the lock pin 78 functions as a ratchet mechanism which will permit fabric net material 12 to be wound onto the cartridge roll 32, thereby permitting the net tension to be uniformly tightened without having to depress the nipple portion 82 of the lock pin, but which will continue to prevent reverse rotation and unwinding of the net material so long as the lock pin remains in the extended position.

By way of example, when it is desired that any amount of new fabric net material 12 is needed to replace soiled or worn net material, all that need be done is to release the edge of the soiled net from the fastener 34, depress the lock pin 78, and then pull out the desired amount of new net from the cartridge roll 32. Thereafter, the old net material is cut off and the free edge of the new net material is secured to the gripper edge fastener 34. To properly tension the new net material 12 over the support surface 20 of the cylinder 14, the lock pin 78 is released to permit the lock pin to return to the extended position, and the the axle assembly 40 is manually turned in the counter clockwise direction to wind in the necessary amount of net material to achieve the proper net tension. Should it be necessary to let out net material 12 from the cartridge roll 32 to achieve proper net tension, the nipple 82 can quickly and easily be depressed to retract the lock pin 78 and free the axle assembly 40 for rotation in the clockwise direction.

From the foregoing, it should be apparent that the present invention provides a new and improved method and apparatus for permitting any amount of soiled or damaged fabric net material to be replaced over the support surface of a transfer or delivery cylinder of a press, and which permits easy and fast net replacement and/or net tension adjustment thereby to reduce lost press production time. Moreover, the present invention allows the press operator to have a constant supply of new net material for replacement when ever needed, and the removable cartridge allows rapid and easy replacement of the net supply when the old cartridge becomes spent. While the foregoing invention has been described in connection with the mounting of the cartridge assembly 10 to the trailing or tail edge 24 of the cylinder 14, there may be instances where it is desirable to mount the cartridge assembly to the leading or gripper edge 22. Should space and press configuration permit mounting to the gripper edge 22, all that need be done is to change the location of the mounting brackets 36 and 38 from the tail edge 24 to the gripper edge, and change the location of the fastening strip 34 from the gripper edge to the tail edge. Of course, the brackets 36 and 38 would also have to be reversed left to right to maintain proper orientation of the cartridge roll 32 with respect to the lock pin 78 to insure that the fabric net material 12 would not unwind during press operation.

Those skilled in the art will appreciate that a variety of modifications and changes to the present invention may be made without departing from the spirit and scope of the invention as defined in the appended claims.

I claim:

1. In a combination with a cylinder of the type used in supporting and conveying printed sheets between processing stations in a rotary printing press, the cylinder having a support surface defined between axially spaced sides and an opening along the axial width thereof forming a cylinder leading edge and a cylinder trailing edge, a cartridge assembly for use in providing a source of supply of anti-smear fabric net material for covering the support surface, said cartridge assembly comprising:

a pair of axially spaced mounting brackets secured to said cylinder adjacent said trailing edge and projecting generally radially inwardly relative to said support surface;

a rotatable axle assembly removably coupled to said mounting brackets and extending therebetween along an axis substantially parallel with said edge, said axle assembly comprising a cylindrical axle and a movable plunger projecting axially from one end thereof and rotatably supported in one of said brackets;

means for releasably locking said axle assembly against removal from said brackets;

means for releasably locking said axle assembly against rotation in one direction with respect to said brackets, said means for locking said axle against rotation in one direction comprising lock means mounted to said one bracket for releasably engaging said plunger to prevent rotation thereof in said one direction but permitting rotation in the opposite direction; and a cartridge roll carrying a continuous supply of fabric net material wound there around, said roll being mounted on said axle and coupled thereto for rotation therewith.

2. A cartridge assembly as set forth in claim 1 wherein said means for releasably locking said axle against removal comprises second lock means mounted to said other of said brackets and an annular groove formed in said axle adjacent said end opposite said one end, said second lock means being disposed to releasably engage said groove in said axle and prevent removal thereof from said brackets.

3. A cartridge assembly as set forth in claim 2 wherein said lock means includes a lock pin moveable between extended and retracted positions within a bore formed in said one bracket, said lock pin having a cylindrical shank portion engaging said plunger to prevent rotation thereof in one direction when said lock pin is in said extended position within said bore, and an annular groove formed therein and disposed to lie adjacent said plunger when said lock pin is in said retracted position, said groove being formed to permit said plunger to rotate relative to said lock pin when said pin is in the retracted position within said bore.

4. A cartridge assembly as set forth in claim 3 wherein said lock pin is biased by a spring toward said extended position within said bore.

5. A cartridge assembly as set forth in claim 4 wherein said second lock means comprises a second lock pin moveable between extended and retracted positions within a bore formed in said other bracket, said second lock pin including a cylindrical shank portion disposed to intercept and lie within said recess when said second lock pin is in said extended position, and an annular groove formed to lie adjacent said recess when said second lock pin is in said retracted position.

6. A cartridge assembly as set forth in claim 5 wherein said cartridge roll comprises a tubular cylinder disposed to surround said axle, and means coupling said roll to said axle for rotation therewith.

7. A cartridge assembly as set forth in claim 6 wherein said roll is formed of plastic.

8. In combination with a cylinder of the type used in supporting and conveying printed sheets between processing stations in a rotary printing press, the cylinder having axially spaced sides and an opening along the axial width thereof defining a cylinder leading edge and a cylinder trailing edge, and having a support surface defined therebetween, a cartridge assembly for use in providing a source of supply of anti-smear fabric net material for covering the support surface, said cartridge assembly comprising:

a pair of axially spaced mounting brackets secured to said cylinder adjacent one of said leading and trailing edges and projecting generally radially inwardly relative to said support surface;

a rotatable axle assembly removably coupled to said mounting brackets and extending therebetween along an axis substantially parallel with said edge, said axle assembly comprising a cylindrical axle and a moveable plunger projecting axially from one end thereof and rotatably supported in one of said brackets;

means for releasably locking said axle assembly against rotation in one direction with respect to said brackets comprising lock means mounted to said one bracket for releasably engaging said plunger to prevent rotation thereof in said one direction but permitting rotation in the opposite direction; and a cartridge roll carrying a continuous supply of fabric net material wound there around, said roll being mounted on said axle and coupled thereto for rotation therewith.

9. A cartridge assembly as set forth in claim 8 wherein said cartridge roll comprises a tubular cylinder made from plastic material.

10. A cartridge assembly as set forth in claim 8 including means for releasably locking said axle against removal from said brackets.

11. A cartridge assembly as set forth in claim 10 wherein said means for releasably locking said axle against removal comprises second lock means mounted to said other of said brackets and an annular recess formed in said axle adjacent said end opposite said one end, said second lock means being disposed to releasably engage said recess in said axle to prevent removal thereof from said brackets.

12. A cartridge assembly as set forth in claim 11 wherein said second lock means comprises a lock pin moveable between extended and retracted positions within a bore formed in said other bracket, said lock pin including a cylindrical shank portion disposed to intercept and lie within said recess when said lock pin is in said extended position, and an annular groove formed to lie adjacent said recess when said pin is in said retracted position.

13. A cartridge assembly as set forth in claim 12 wherein said lock pin is biased by a spring toward said extended position within said bore.

14. A cartridge assembly as set forth in claim 13 wherein said second lock means includes a second lock pin moveable between extended and retracted positions within a bore formed in said one bracket, said second lock pin having a cylindrical shank portion engaging said plunger to prevent rotation thereof in one direction when said second lock pin is in said extended position within said bore, and an annular groove formed therein and disposed to lie adjacent said plunger when said second lock pin is in said retracted position, said groove being formed to permit said plunger to rotate relative to said second lock pin when said pin is in the retracted position within said bore.

15. A cartridge assembly as set forth in claim 14 wherein said cartridge roll comprises a tubular cylinder disposed to surround said axle, and means coupling said roll to said axle for rotation therewith.

16. A cartridge assembly as set forth in claim 15 wherein said roll is formed of plastic.

17. In combination with a cylinder of the type used in supporting and conveying printed sheets between processing stations in a rotary printing press, the cylinder having axially spaced sides and an opening along the axial width thereof defining a cylinder leading edge and a cylinder trailing edge with a support surface extending therebetween, a cartridge assembly for use in providing a source of supply of anti-smear fabric net material for covering the support surface, said cartridge assembly comprising:

a pair of axially spaced mounting brackets secured to said cylinder adjacent said trailing edge and projecting generally radially inwardly relative to said support surface;

a rotatable axle assembly removably coupled to said mounting brackets and extending therebetween along an axis substantially parallel with said trailing edge, said axle assembly comprising an axle rotatably supported at one end by one of said brackets, and a movable plunger projecting axially from the end of said axle opposite said one end and releasably supported by the other of said brackets;

means for releasably locking said axle assembly against rotation with respect to said brackets comprising lock means supported by said other bracket and releasably engaging said plunger to prevent rotation thereof;

means for releasably locking said axle assembly against removal from said rackets comprising second lock means supported by said one bracket and releasably engaging said axle;

said first and second lock means each comprising a lock pin mounted for movement between extended and retracted positions within a bore formed in each of said mounting brackets, said lock pin having a cylindrical shank portion engaging said axle assembly when said pin is in the extended position, and an annular groove formed to lie adjacent said axle assembly when said pin is in the retracted position; and a cartridge roll carrying a continuous supply of fabric net material wound there around, said roll being mounted on said axle and coupled thereto for rotation therewith.

18. A cartridge assembly as set forth in claim 17 wherein each of said lock pins are spring biased toward the extended position.

19. A cartridge assembly as set forth in claim 18 wherein said cartridge roll comprises a tubular cylinder formed of plastic, said roll being removably coupled around said axle.

* * * * *

UNITED STATES PATENT AND TRADEMARK OFFICE

CERTIFICATE OF CORRECTION

PATENT NO. : 5,046,421

DATED : September 10, 1991

INVENTOR(S) : Howard W. DeMoore

It is certified that error appears in the above-identified patent and that said Letters Patent is hereby corrected as shown below:

Column 6, line 19, delete "7" and replace with --72--.

Column 7, line 25, delete "4" and replace with --46--.

Column 7, line 45, delete "8" and replace with --82--.

In Claim 5, Column 10, lines 16 and 18, delete "recess" and replace with --bore--, in both occasions.

In Claim 14, Column 11, line 18, delete "second"(1st. occr.

In Claim 17, Column 12, line 21, delete "rackets" and replace with --brackets--.

Signed and Sealed this

Ninth Day of February, 1993

*Attest:*

STEPHEN G. KUNIN

*Attesting Officer*

*Acting Commissioner of Patents and Trademarks*